United States Patent [19]

Maxsted

[11] 4,142,598

[45] Mar. 6, 1979

[54] TWO STAGE LARGE DIAMETER DRILL BIT

[75] Inventor: Malcolm D. Maxsted, Harbor City, Calif.

[73] Assignee: Smith International, Inc., Newport Beach, Calif.

[21] Appl. No.: 799,254

[22] Filed: May 23, 1977

[51] Int. Cl.[2] ..... E21B 9/22

[52] U.S. Cl. ..... 175/344; 175/53; 175/334; 175/385

[58] Field of Search ..... 175/331, 334, 335, 339, 175/340, 344, 357, 364, 374, 375, 385, 386, 53, 342, 384, 413, 381, 382, 383; 299/80

[56] References Cited

U.S. PATENT DOCUMENTS

| | | | |
|---|---|---|---|
| 3,659,660 | 5/1972 | Conn | 175/53 |
| 3,797,592 | 3/1974 | Goodfellow | 175/325 |
| 4,010,808 | 3/1977 | Youngblood | 175/342 X |
| 4,049,067 | 9/1977 | Dively | 175/384 X |
| 4,071,098 | 1/1978 | Dively et al. | 175/53 |

*Primary Examiner*—Ernest R. Purser
*Assistant Examiner*—Nick A. Nichols, Jr.
*Attorney, Agent, or Firm*—Robert M. Vargo

[57] ABSTRACT

A large diameter drill bit is disclosed that is capable of drilling various size bores. In the preferred embodiment, the drill functions as a raise bit for enlarging a pilot hole into a larger diameter hole by disintegrating the earth formations surrounding the pilot hole. In the primary stage, the raise bit includes a primary body supporting a plurality of yokes positioned at various radial locations thereon. A frusto-conical cutter is rotatively mounted on each yoke for contacting and disintegrating the above-mentioned earth formations, with the outermost cutters forming the gage row. For the second stage, in which larger diameter holes are to be drilled, a plurality of ear assemblies are provided for attachment to the primary body at circumferential locations between the outermost primary cutters. Each ear assembly comprises a unitary support frame having a yoke and cutter mounted thereon. A vertically oriented roller stabilizer is also mounted on each support frame. The ear assembly cutters are positioned to extend radially outwardly beyond the outermost cutters located on the primary body to form a new and expanded gage row. Each ear assembly support frame includes a plurality of locating pads which are adapted to register with mating pads located on the primary body and bolts are provided to extend through the interfaced locating pads to secure the support frame to the primary body.

9 Claims, 4 Drawing Figures

10
11
13
15
17
31
38
40
41
42
43
44
45
46
70
1
2
3
4
5
6
7
8

13
31
40
41
42
43
47
49
51
53
55
57
59
61
63
65
69
70
73
74

TWO STAGE LARGE DIAMETER DRILL BIT

BACKGROUND OF THE INVENTION

1. Field of the Invention

The present invention relates generally to the drilling of large diameter shafts and, more particularly, to the drill bits utilized in such applications.

2. Description of the Prior Art

Large diameter bits have been used in mines for the drilling of rescue shafts, ventilation shafts and access shafts. Such bits have been designed in diameter ranges from approximately twenty-eight inches to one-hundred forty-four inches and larger.

Conventional large diameter bits comprise a flat bottom body forming a support structure for a plurality of rolling cutters. These cutters are frusto-conical in shape and are usually rotatively mounted on yokes which in turn are welded to the bit body base plate. Various sizes of cutters or combination of cutters can be mounted, either in the gage (periphery) positions or in the inner positions. The drill bits can be utilized as a raise drill or as a blind hole borer, drilling either in the upward or downward direction. The raise bit is used in a raise drilling operation to provide a relatively large diameter hole from a first mine level to a second mine level. The raise drilling operation begins by drilling a small diameter pilot hole through the earth from a first location to an opening at a second location using a small diameter pilot bit. After the pilot hole is completed, the pilot bit is removed from the drill column and the raise bit is attached thereto. The raise bit is rotated with an upward vertical pull and drawn along the pilot hole thereby enlarging the pilot hole to the desired size.

A major problem with large diameter bits is that they are quite difficult to transport through small drifts or passages and very cumbersome to maneuver inside such structures. Quite often the size of these passages severly restricts the type and size drill bit utilized.

Another problem encountered is that various size shafts are required for different applications in a single mine location. As a result either various sizes of drill bits must be available, which is quite costly, or compromises must be made in hole size selection.

SUMMARY OF THE INVENTION

The present invention obviates the above-mentioned shortcomings by providing a large diameter drill bit having demountable ear assemblies which enables one bit to drill various size bores.

In its broadest aspect, the present invention pertains to a large diameter bit having a plurality of cutters mounted on a base plate. A plurality of ear assemblies are adapted to be detachably connected to the base plate with each ear assembly having one or more cutters positioned beyond the radial extension of the original gage cutters, thereby forming a new set of gage cutters of a larger diameter.

The advantage of the present invention is that the smaller primary body and the separated ear assemblies are easier to transport and maneuver within small drifts. Another advantage of the present invention is that larger diameter drill bits can now be utilized in mines where previously only smaller diameter drill bits could be utilized because of the restrictions in transporting the drill bits therethrough. Another advantage of utilizing variable diameter drill bits is that a large supply of various size drill bits is not necessary at each mine location, thereby resulting in a cost savings. Another advantage is that the ear assembly cutters cut on the same cutting surface as the primary body cutters thus reducing torque loading of the drill bit. Also this feature reduces cutter wear, i.e. only one set of cutters cut gage as opposed to the step-type stage body where you have two sets of cutters cutting gage.

The features of the present invention, which are believed to be novel, are set forth with particularity in the appended Claims. The present invention, both as to its organization and manner of operation, together with the further advantages thereof, may best be understood by reference to the following description taken in connection with the accompanying drawings.

DESCRIPTION OF THE PREFERRED EMBODIMENT

Figure 1:
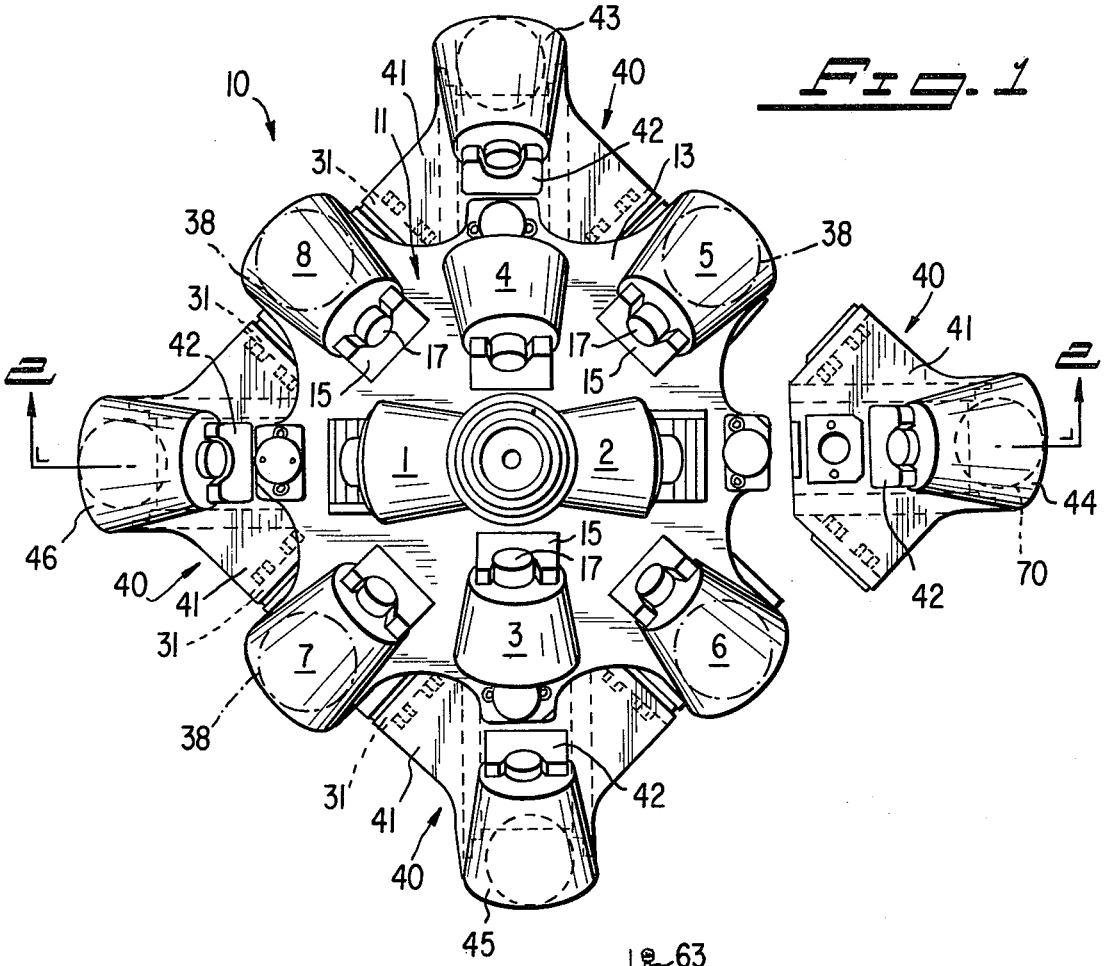
FIG. 1 is a plan view of a two stage large diameter drill bit having a primary stage body and ear assemblies attached thereto for a larger stage.
Figure 2:
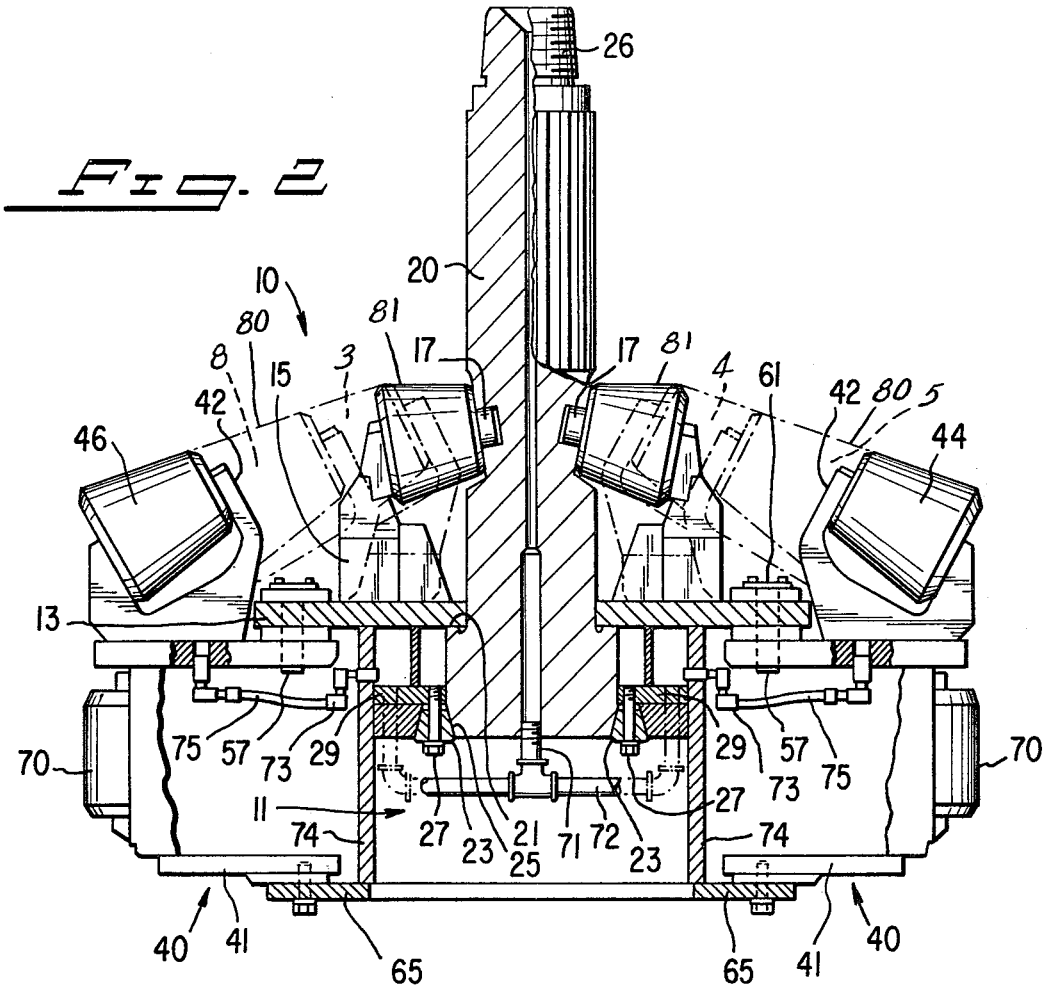
FIG. 2 is a sectional view of the drill bit taken along lines 2—2 of FIG. 1.

Referring now to the drawings, FIGS. 1 and 2 illustrate a two stage large diameter drill bit, generally indicated by arrow 10, comprising a primary stage body generally indicated by arrow 11, which consists of a base plate 13 having a plurality of yokes 15 mounted thereon. Frusto-conical cutters indicated by numbers 1 through 8 respectively are rotatively mounted in the yokes 15 to form the primary stage drill. Each cutter 1 through 8 includes an axial pin 17 which is fixedly supported by both ends of the yoke 15.

As more clearly shown in FIG. 2, the drill bit 10 is a raise drill having a replaceable drive stem 20 extending through a central bore formed in the base plate 13. The raise bit 10 may be transported through small drifts or passages by removing the drive stem 20 and transporting the drive stem 20 and the primary stage body 11 through the small drifts or passages separately. The drive stem 20 includes a shoulder 21 which is adapted to abut the bottom surface of the base plate 13, and is secured in that abutting relationship by means of a plurality of wedge blocks 23. The wedge blocks 23 are adapted to engage a plurality of tapered flat surfaces 25 located on the lower end of the drive stem 20 and are locked into engagement by a plurality of bolts 27 which, in turn, are threaded into an intermediate plate 29 of the primary stage body 11. The raise bit 10 is adapted to be connected to a rotary drill column by a threaded connection 26.

In the primary stage, the cutters 1 and 2 are the radially innermost cutters and are positioned to engage the portion of the bore end face adjacent the drive stem 20. The cutters 3 and 4 are positioned to extend radially outward beyond the cutters 1 and 2 to engage the intermediate area of the bore end face. In FIG. 2, the cutters 3 and 4 are shown in phantom and have been rotated to be superimposed on the same sectional plane as cutters 1 and 2. The cutters 5, 6, 7, and 8 form the gage cutters of the primary stage bit body 11 and are located on the radially outermost position thereof. In FIG. 2, the cutters 5 and 8 are shown in phantom and have been rotated to be superimposed on the same sectional plane as cutters 1 and 2. The superpositioning of the cutters 3, 4, 5 and 8 illustrate that these cutters have upper extents which have rolling contact with the face of the bore to be drilled and that the cutting surface formed by these cutters 3, 4, 5 and 8 (along with cutters 6 and 7) is a conical surface indicated by arrow 80. The rolling contact of the cutters 1 and 2 forms a small secondary inner cutting surface indicated by arrow 81. As a result, the drill bit 10 cuts a frusto-conical surface on the bore face which includes the surfaces 80 and 81.

Figure 3:
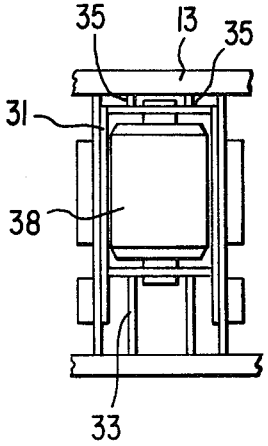
FIG. 3 is a fragmentary view of the primary stage stabilizers.

A pair of support plates 31 (see FIG. 4) are mounted below the base plate 13 directly beneath each gage cutter 5, 6, 7, and 8 respectively, for forming a compartment for receiving a stabilizer frame 33. As shown in FIG. 3, a pair of mounting plates 35 form a portion of the stabilizer frame 33 which, in turn, rotatively supports a roller stabilizer 38. Each support plate 31 includes a plurality of holes which are adapted to register with holes formed in each mounting plate 35. A plurality of bolts are utilized to extend through the mating holes of the support plates 31 and mounting plates 35 to secure the stabilizer frame 33 to the primary body 11. The stabilizers 38 are utilized when only primary body 11 is utilized and the cutters 5, 6, 7, and 8 form the gage cutters. Such stabilizers function to keep the raise drill aligned with the centerline of the pilot hole, causing the drill to move in essentially a straight path.

In the preferred embodiment when the drill bit 10 is utilized in its primary stage, it is dimensioned to drill a bore of 72 inches. When it is desired to make a larger bore, a plurality of ear assemblies 40 are adapted to be mounted on to the primary body 11 to expand the radial dimension thereof. Each ear assembly 40 comprises a support frame 41 having a yoke 42 mounted thereon. A frusto-conical cutter 43, 44, 45, and 46 respectively, is adapted to be supported by a yoke 42. As shown in FIG. 2 the cutters 44 and 46, as well as the cutters 43 and 45, have an upper extent for rollingly engaging the bore face that forms a cutting surface which is continuous with the cutting surface 80.

Figure 4:
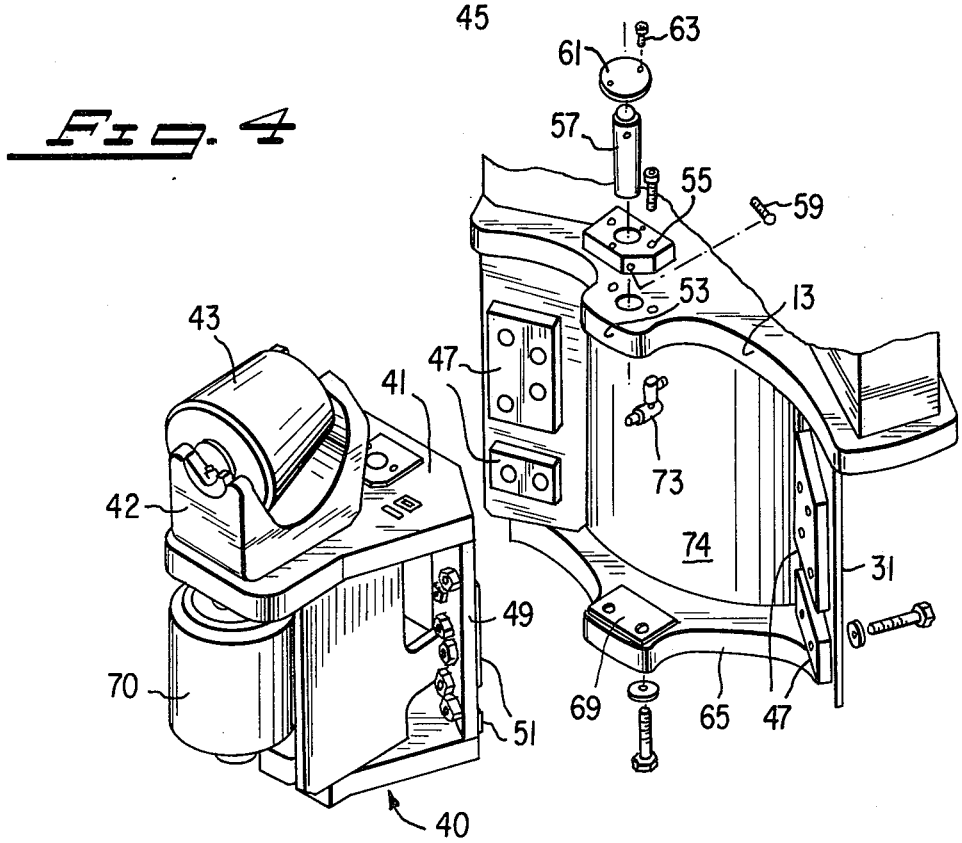
FIG. 4 is a fragmentary exploded perspective view of the detachable ear assembly being connected to the primary stage body.

FIG. 4 more clearly shows the means of attaching each ear assembly 40 to the primary stage body 11. A plurality of locating pads 47 are integrally attached to the support plates 31. A pair of ear assembly support plates 49 form a portion of each support frame 41 with each support plate 49 including a plurality of locating pads 51 which are adapted to register and engage the locating pads 47. Mating holes are formed in the pads 47 and 51 and bolts are provided to secure the ear assembly frames 41 to the support plates 31.

A center hole located on a flange 53 of the base plate 13 is adapted to register with a center hole located on the ear assembly support frame 41. A locator plate 55 is provided to extend over the flange 53 having a hole mating with the center hole to receive a locater pin 57. The locater pin 57 is adapted to extend through the mating holes and is secured therein by means of a cap screw 59. A cover plate 61 extends over the locater pin 57 and is secured thereto by a pair of cap screws 63.

The primary body 11 also includes a lower plate 65 attached to the bottoms of the support plates 29. A flange 67, similar to flange 53, is located on the lower plate 65 and includes a locating pad 69 having holes registering with mating holes located on the bottom side of the support frame 41. The two members are secured by means of a plurality of bolts.

Each ear assembly 40 further includes a roller stabilizer 70 rotatively mounted thereon to function for the larger drill bit in the same manner as stabilizers 38 functioned for the primary stage.

In the preferred embodiment, after the ear assemblies 40 are attached to the primary body 11, the cutters 43 through 46 form the expanded gage row cutters enabling the raise bit to have an extended boring capacity of 96 inches in diameter. It should be noted that the original stabilizers 38 have been removed in order to allow the ear assemblies 40 to be attached to the primary body 11 utilizing the same support plates 31. This, of course, saves a duplication of attaching structure. It should also be noted that the support plates 31 are substantially located on a radial plane to more effeciently absorb the torsional loads acting thereon.

As shown in FIG. 2, a water conduit 71 extends down through the center of the drill string and drill stem 20 and is connected to a plurality of branches 72 which, in turn, extend through various portions of the base plate 13 and yokes 15 to spray water on to the rotating cutters 1 through 8 respectively for cooling purposes. The water conduit 71 is also connected to a plurality of valved connections 73 extending through the wall sections 74 of the primary body 11. Each valve connection 73 is adapted to be attached by a hose assembly 75 which, in turn, extends through the support frame 41 to enable cooling water to be connected to the ear assembly gage cutters 43 through 46 respectively.

As stated earlier, the large diameter raise bit can bore a hole either 72 inches in diameter, utilizing the primary stage, or 96 inches in diameter, utilizing the ear assembly installation. It should also be noted that, when utilized, the gage cutters 43 through 46 cut on the same continuous cutting surface 80 as the cutters 5, 6, 7, and 8 of the primary stage. As a result, in the extended configuration, the cutters 5, 6, 7, and 8 do not function as gage cutters thereby saving a great deal of wear on such cutters since most of the wear on cutters occur in the gage row.

It should be noted that various modifications can be made to the assembly while still remaining within the purview of the following claims. For example, the drill bit can also be utilized as a blind hole drill or a box hole drill instead of a raise drill. The only difference in structure would be the stem connection.

What is claimed is:

1. A large diameter drill bit comprising:

a primary body having a base plate;

a plurality of cutters rotatively mounted on said base plate, said cutters oriented radially on said base plate with at least two cutters in a radially outermost position to form the primary gage cutters, each primary gage cutter having an upper extent adapted to have rolling contact with a bore face to form a continuous cutting surface on the bore face;

at least two ear assemblies, each ear assembly detachably connected to said main body base plate between a pair of primary gage cutters, each ear assembly comprising a support frame having at least one cutter rotatively mounted thereon, each ear assembly cutter having an upper extent adapted to have rolling contact with a bore face to form a cutting surface which is continuous with the cutting surface formed by the primary gage cutters, each ear assembly is mounted in such a manner as to enable the ear assembly cutters to extend outwardly beyond the radial extensions of the primary gage cutters to form a new set of gage cutters of a larger diameter; and each ear assembly further including a roller stabilizer rotatively mounted on the support frame.

2. The combination of claim 1 wherein each of said cutters on said primary body and ear assembly comprises a frusto-conical cutter body having a plurality of cutter teeth positioned on said frusto-conical surface.

3. The combination of claim 1 wherein the original gage cutters on the main body are in multiples of two positioned in diametrically opposed locations.

4. The combination of claim 3 wherein the ear assemblies are in multiples of two, positioned in diametrically opposed locations.

5. The combination of claim 1 wherein said primary body further comprises a pair of support plates mounted below the base plate for each ear assembly, said support plates having a plurality of holes formed therein for receiving bolts; and each ear assembly frame having holes registering with the holes on said support plates to enable the bolts to secure the ear assembly frame to said support plates.

6. The combination of claim 5 wherein each of said support plates are positioned substantially in a radial plane with respect to said primary body in order to more efficiently absorb the torsional loads of the ear assembly connection.

7. A large diameter drill bit comprising:

a primary body having a base plate;

a plurality of cutters rotatively mounted on said base plate, said cutters oriented radially on said base plate with at least two cutters in a radially outermost position to form the primary gage cutters, each primary gage cutter having an upper extent adapted to have rolling contact with a bore face to form a continuous cutting surface on the bore face;

at least two ear assemblies, each ear assembly detachably connected to said main body base plate between a pair of primary gage cutters, each ear assembly comprising a support frame having at least one cutter rotatively mounted thereon, each ear assembly cutter having an upper extent adapted to have rolling contact with a bore face to form a cutting surface which is continuous with the cutting surface formed by the primary gage cutters, each ear assembly is mounted in such a manner as to enable the ear assembly cutters to extend outwardly beyond the radial extensions of the primary gage cutters to form a new set of gage cutters of a larger diameter; and said primary body including means on said base plate for supporting a roller stabilizer mounted below each primary gage cutter, said roller stabilizer support means comprising a pair of support plates mounted below the base plate adjacent each primary gage cutter, said support plates having a plurality of holes formed therein for receiving bolts, said roller stabilizer being integral with mounting plates having holes registering with the holes on said support plates to enable the bolts to secure the stabilizer mounting plates to said support plates.

8. The combination of claim 7 wherein said support plates are utilized as the support means for the ear assemblies.

9. The combination of claim 8 wherein said support frame of each ear assembly further includes a plurality of holes adapted to register with the holes on said support plate to enable the bolts to secure the ear assembly to said support plates.

* * * * *